US005894889A

United States Patent [19]

Dewey et al.

[11] Patent Number: 5,894,889

[45] Date of Patent: Apr. 20, 1999

[54] ONE TRIP MILLING SYSTEM

[75] Inventors: Charles H. Dewey, Houston; James E. Saylor, III, Kingwood; Bruce D. Swearingen, The Woodlands, all of Tex.; Andrew MacDonald Robin, Tarves; Alexander William Dawson, Keith Banffshire, both of United Kingdom; Gregory S. Nairn, Humble, Tex.

[73] Assignee: Smith International, Inc., Houston, Tex.

[21] Appl. No.: 08/916,932

[22] Filed: Aug. 21, 1997

Related U.S. Application Data

[63] Continuation-in-part of application No. 08/642,829, May 3, 1996, Pat. No. 5,771,972.

[51] Int. Cl.[6] ..... E21B 7/08

[52] U.S. Cl. ..... 166/298; 166/117.5; 175/81

[58] Field of Search ..... 166/117.5, 313, 166/384, 298; 175/81

[56] References Cited

U.S. PATENT DOCUMENTS

| | | | |
|---|---|---|---|
| 1,387,447 | 8/1921 | Alford . | |
| 2,124,414 | 7/1938 | Goldman | 255/71 |
| 2,216,963 | 10/1940 | Sinclair | 255/1 |
| 2,334,746 | 11/1943 | Brantly | 255/1.6 |
| 3,330,349 | 7/1967 | Owsley et al. | 166/21 |
| 3,908,759 | 9/1975 | Cagel et al. | 166/117.6 |
| 4,182,423 | 1/1980 | Ziebarth et al. | 175/61 |
| 4,266,621 | 5/1981 | Brock | 175/329 |
| 4,397,355 | 8/1983 | McLamore | 166/297 |
| 4,397,360 | 8/1983 | Schmidt | 175/61 |
| 4,765,404 | 8/1988 | Bailey et al. | 166/177.6 |
| 5,109,924 | 5/1992 | Jürgens et al. | 166/117.5 |
| 5,113,938 | 5/1992 | Clayton | 166/117.6 |
| 5,199,513 | 4/1993 | Stewart et al. | 175/73 |

(List continued on next page.)

FOREIGN PATENT DOCUMENTS

| | | |
|---|---|---|
| 2299105 | 9/1996 | United Kingdom . |
| 2303158 | 2/1997 | United Kingdom . |

OTHER PUBLICATIONS

*Track Master Sidetracking System*; Feb. 24, 1995; (1 sheet).

A–Z Grant International; *Casing Sidetrack Systems*; undated; (7 pgs.).

A–Z SERVCO Performance Bulletin; Smith International, Inc.; 1995 (1 pg.).

*Primary Examiner*—Frank Tsay

*Attorney, Agent, or Firm*—Conley, Rose & Tayon, P.C.

[57] ABSTRACT

The side tracking system includes a window mill having a full diameter cutting surface and a reduced diameter tapered cutting surface and a whipstock having a ramp engaging the reduced diameter cutting surface. The materials of the whipstock have a first cutablity and the materials of the casing have a second cutability. The reduced diameter cutting surface contacts the whipstock ramp at a first contact area and the fill diameter cutting surface contacts the wall of the casing at a second contact area. As weight is applied to the mill, there is a first contact stress at the first contact area and a second contact stress at the second contact area. A cutability ratio is the first cutability divided by the second cutability and a contact stress ratio is the first contact stress divided by the second contact stress. The mill cuts the casing rather than the whipstock by maintaining the product of the cutability ratio and the contact stress ratio less than one. Preferably the height of the reduced diameter cutting surface is greater than the height of the full diameter cutting surface. The ramp includes a plurality of surfaces having different angles whereby the rate of deflection of the mill by the whipstock varies as the mill is lowered into the borehole. In particular, the ramp of the whipstock includes two surfaces having steep angles, one steep angled surface causing the mill to punch through the wall of the casing and the second steep angle surface moving the center of the mill across the wall of the casing.

30 Claims, 10 Drawing Sheets

U.S. PATENT DOCUMENTS

| | | | |
|---|---|---|---|
| 5,277,251 | 1/1994 | Blount et al. | 166/117.5 |
| 5,383,522 | 1/1995 | Hailey | 166/382 |
| 5,445,222 | 8/1995 | Pritchard et al. | 166/298 |
| 5,452,759 | 9/1995 | Carter et al. | 166/117.6 |
| 5,467,819 | 11/1995 | Braddick | 166/117.6 |
| 5,474,126 | 12/1995 | Lynde et al. | 166/117.6 |
| 5,484,021 | 1/1996 | Hailey | 166/297 |
| 5,499,680 | 3/1996 | Walter et al. | 166/377 |
| 5,499,682 | 3/1996 | Sieber | 166/382 |
| 5,551,509 | 9/1996 | Braddick | 166/55.7 |
| 5,592,991 | 1/1997 | Lembcke et al. | 166/298 |
| 5,595,247 | 1/1997 | Braddick | 166/297 |

ONE TRIP MILLING SYSTEM

CROSS REFERENCE TO RELATED APPLICATIONS

This application is a continuation-in-part of U.S. patent application Ser. No. 08/642,829 filed May 3, 1996, now U.S. Pat. No. 5,771,972, and is related to a patent application entitled Two Trip Window Cutting System, Ser. No. 572, 592, filed Dec. 14, 1995, both incorporated herein by reference.

BACKGROUND OF THE INVENTION

1. Field of the Invention

This invention relates to a method and apparatus for drilling a secondary borehole from an existing borehole in geologic formations and more particularly, to a tapered window mill and whipstock combination that in one trip, can drill a deviated borehole from an existing earth borehole or complete a side tracking window in a cased borehole.

2. Background

Traditionally, whipstocks have been used to drill a deviated borehole from an existing earth borehole. The whipstock has a ramp surface which is set in a predetermined position to guide the drill bit on the drill string in a deviated manner to drill into the side of the earth borehole. In operation, the whipstock is set on the bottom of the existing earth borehole, the set position of the whipstock is surveyed, the whipstock is properly oriented for directing the drill string in the proper direction, and the drilling string is lowered into the well into engagement with the whipstock causing the whipstock to orient the drill string to drill a deviated borehole into the wall of the existing earth borehole.

Previously drilled and cased wellbores, for one reason or another, may become non-productive. When a wellbore becomes unusable, a new borehole may be drilled in the vicinity of the existing cased borehole or alternatively, a new borehole may be sidetracked from or near the bottom of a serviceable portion of the cased borehole. Sidetracking from a cased borehole is also useful for developing multiple production zones.

Sidetracking is often preferred because drilling, casing and cementing the borehole is avoided. This drilling procedure is generally accomplished by either milling out an entire section of casing followed by drilling through the side of the now exposed borehole, or by milling through the side of the casing with a mill that is guided by a wedge or "whipstock" component.

Drilling a side tracked hole through casing made of steel is difficult and often results in unsuccessful penetration of the casing and destruction of the whipstock. In addition, if the window is improperly cut, a severely deviated dog leg may result rendering the sidetracking operation unusable.

Several patents relate to methods and apparatus to sidetrack through a cased borehole. U.S. Pat. No. 4,266,621 describes a diamond milling cutter for elongating a laterally directed opening window in a well casing that is set in a borehole in an earthen formation. The mill has one or more eccentric lobes that engage the angled surface of a whipstock and cause the mill to revolve on a gyrating or non-fixed axis and effect oscillation of the cutter center laterally of the edge thus enhancing the pipe cutting action.

The foregoing system normally requires at least three trips into the well in the sidetracking operation. A first stage begins a window in the casing, a second stage extends the window through use of a diamond milling cutter and a third stage with multiple mills elongates and extends the window. While the window mill is aggressive in opening a window in the casing, the number of trips, such as three, to accomplish the task is expensive and time consuming.

Typically window mills are designed with a square bottom, i.e. a square cross-section. As is shown in FIG. 14, a prior art square bottomed, cross-sectioned mill provides a point of contact between the mill and the whipstock and a large axial surface contact between the mill and the casing. As can be appreciated from FIG. 14, the contact area between the square bottomed mill and whipstock is substantially a line contact while the contact area between the mill and casing is much greater. The applied force, due to the weight on bit, per contact area determines the contact stress between the members. Because the contact stress between the mill and the casing is much greater than the contact stress between the mill and whipstock, the mill tends to cut into the whipstock rather than into the casing even where the cutability of the whipstock has been reduced because of hardfacing.

U.S. Pat. Nos. 2,216,963; 3,908,759; and 4,397,355 disclose mills having a taper or tapered nose. A starter mill with a tapered nose will eventually wedge and cannot complete the window or drill the lateral borehole. U.S. Pat. No. 3,908,759 appears to disclose a taper on the mill. U.S. Pat. No. 2,216,963 discloses a tapered mill which is used in a second trip into the well to increase the window after a square bottomed mill opened the window in a previous trip into the borehole. These patents do not teach guiding and moving these tapered mills laterally through the casing so that at least the center of the downwardly facing cutting surface of these mills passes outside the exterior wall of the casing in one trip into the borehole. At least two trips are required into the well, typically using a starter mill in the first trip to begin cutting a window in the casing and then a second mill in a second trip to increase the window. Further, tapered mills are typically less than full gauge requiring additional trips into the borehole to complete the window.

Weatherford Enterra offers a mill which has a taper extending upwardly and inwardly from a full diameter cutting base. The mill also includes a support shoulder on the cutting face of the mill. However, the reduced diameter taper extends above the full diameter cutting gage of the mill which therefore tends to cut the whipstock rather than the casing.

U.S. Pat. No. 5,109,924 teaches a one trip window cutting operation to sidetrack a wellbore. A deflection wedge guide is positioned behind the pilot mill cutter and spaced from the end of a whipstock component. The shaft of the mill cutter is retained against the deflection wedge guide such that the milling tool frontal cutting surface does not come into contact with the ramped face of the whipstock. In theory, the deflection wedge guide surface takes over the guidance of the window cutting tool without the angled ramp surface of the whipstock being destroyed.

However, when a second and third milling tool attached to the same shaft as the window milling cutter and spaced, one from the other on the support shaft contacts the whipstock ramped surface, they mill away the deflection guide projection from the ramp surface. This inhibits or interferes with the leading pilot mill window cutter from sidetracking at a proper angle with respect to an axis of the cased borehole and may cause the pilot window cutting mill to contact the ramp surface of the whipstock before the pilot window cutter mill clears the casing. The reamers or mills aligned behind the pilot window mill, having the same or larger diameter than the diameter of the pilot window mill, prevents or at least inhibits the window pilot mill from easily exiting from the steel casing. This difficulty is due to the lack of clearance space and flexibility of the drill pipe assembly making up the one trip window cutting tool when each of the commonly supported reamer mills spaced along the shaft, sequentially contact the window in the steel casing. Hence, the sidetracking apparatus tends to go straight rather than be properly angled through the steel pipe casing.

U.S. Pat. No. 5,445,222 teaches a combination whipstock and staged sidetrack mill. A tapered, cone-shaped mill is located on the end of a common shaft and has an outer diameter of about 50 to 75 percent of the maximum diameter to which the final sidetracked hole will be completed. Three stages of cutting mills are disposed above the tapered mill on the common shaft. Each successive stage increases in diameter. A surface of a second stage cutter is, at its smallest diameter, about the diameter of the maximum diameter of the tapered mill, and is, at its largest diameter, at least 5 percent greater in diameter than the diameter of the tapered mill. A surface of a final stage cutter mill is, at its largest diameter, about the final diameter dimension, and at the smallest cutting surface diameter, is a diameter of at least about 5 percent smaller than the final diameter dimension. The whipstock guide is made of a material that is harder than the casing but not as hard as the cutting elements of the mill whereby the mill is to cut the casing rather than the whipstock.

The sidetracking mill is designed to accomplish the milling operation in one trip. The mill however, tends to go straight and penetrate the ramped surface of the whipstock. Substantial damage to the whipstock occurs and sidetracking may not occur as a result.

While the intent is to perform a sidetracking operation in one trip, difficulties often arise when attempting to deviate the drill string from its original path to an off line sidetracking path. Progressively larger in diameter reaming stages to enlarge the window in the steel casing inhibits the drill shaft from deviating or flexing sufficiently to direct the drill pipe in a proper direction resulting in damage to the whipstock and misdirected sidetracked boreholes. In other words, the sidetracking assembly tends to go straight rather than deviating through the steel casing.

The present invention overcomes these deficiencies in the prior art.

SUMMARY OF THE INVENTION

The side tracking system of the present invention includes a window mill having a tapered cutting surface which allows the mill to initiate the cutting of a window into the casing and to move the center of the downwardly facing cutting surface of the mill laterally through the window and past the exterior wall of the casing in one trip into the well without substantially cutting up the whipstock. The tapered cutting surface of the window mill includes taper from a full diameter cutting surface to a reduced diameter cutting surface adjacent the downwardly facing bottom cutting surface of the mill. The mill preferably is used in combination with a whipstock having a ramp which engages the tapered cutting surface of the mill forming a large contact area between the mill and whipstock. The materials of the casing have a first cutablity and the materials of the whipstock have a second cutability.

The tapered cutting surface contacts the whipstock ramp at a first contact area and the full diameter cutting surface of the mill contacts the wall of the casing at a second contact area. As weight is applied to the mill, there is a first contact stress at the first contact area and a second contact stress at the second contact area. The ratio of cutability of the mill with the whipstock and casing is the first cutability divided by the second cutability and the ratio of the contact stress of the mill with the whipstock and casing is the first contact stress divided by the second contact stress. The mill of the present invention cuts the casing rather than the whipstock by maintaining the product of the cutability ratio and the contact stress ratio less than one. This also causes the height of the tapered cutting surface to be at least 50% of the total height, the total height being the distance from the top of the largest diameter cutting surface on the mill to the bottom of the mill.

An object of the present invention is to achieve a cutability ratio times the contact stress ratio of the mill with the whipstock and casing which is less than one such that the mill tends to cut the casing rather than the whipstock. Thus it is a further objective to maximize the contact area between the mill and the whipstock such as by having a tapered cutting surface on the mill and a ramp on the whipstock which has angle substantially the same as the taper of the tapered cutting surface on the mill. Additionally, the contact area is maximized by causing the height of the tapered cutting surface to be at least 50% of the total height of the mill which is the height of the tapered cutting surface and the full diameter cutting surface.

It is an object of this invention to provide a side tracking system which will deflect and move the tapered mill laterally through the casing so that at least the center of the downwardly facing cutting surface of the mill passes outside the exterior wall of the casing in one trip into the borehole. Further it is an object to provide a side tracking system in two trips or less and preferably a one trip cutting system for cutting a deviated hole in an existing earth borehole.

It is another object of this invention to provide a one trip window cutting system for cutting an opening in a pipe casing for subsequent side tracking drilling operations.

More specifically, it is an object of this invention to provide a mill with a tapered cutting end which matches the ramp angle of the whipstock face such that in operation, as the drill string is rotated downwardly, the face of the whipstock forces the tapered cutting end of the window mill out through the pipe casing. The angled face of the whipstock adjacent to the window cutting mill and the cutter mill itself is hardfaced to minimize damage to both the whipstock and the cuter mill.

A one trip side track window cutting apparatus for cutting sidetracking windows in a casing positioned in previously drilled boreholes consist of a window cutting mill affixed to an end of a shaft, a body of the mill forming a tapered cutting end.

A whipstock forms a ramp, the angle of which substantially parallels an angle of the tapered cutting end of the window mill. The ramp acts as a bearing surface for laterally forcing the window mill into the pipe casing. The face of the whipstock changes the rate of deflection of the window mill into the pipe casing.

The whipstock upstream end is ramped about 15° to match a 15° taper at the end of the window mill cutter. The whipstock upper end is attached to the end of the window mill cutter at the 15° interface through a shear bolt extending from a blade of the window mill for installation of the whipstock in a cased borehole. The end of the whipstock is heavily hardfaced, especially adjacent the interface with the window cutter mill. Another mill is positioned upstream of the window mill on the same supporting shaft and is preferably the same diameter as the window mill. When the shear bolt is sheared through an upward force on the drilling string after the whipstock is anchored and properly oriented in the cased borehole, the hardfaced ramp formed by the end of the whipstock forces the window mill immediately into the wall of the casing. Simultaneously, the second mill spaced from the window mill is forced into the casing thus starting two openings in the casing. The whipstock face below the 15° ramp parallel the walls of the casing for a distance to allow both the window mill and the second mill to cut the window started by the initial 15° ramp. As the window cutting process proceeds, the ramp surface of the whipstock transitions into a "normal" 3° ramp for a sufficient distance for the window mill to extend about half way out of the casing where the ramped surface of the whipstock transitions again to a more aggressive angle to further urge the window mill out of the casing.

Once the window mill is centered on the wall of the casing, further cutting becomes difficult because of the reduced rotation of the cutting edges at the center of the tapered window mill. At the exact center of the tapered window mill, there is essentially zero rotation. Thus, in the prior art, it took a long cutting time to have the window mill move and cut past its center line. On a standard 3° whip face, it often took a drilling length of plus or minus ten inches to have the center line of the window mill cross the wall of the casing. Very slow drilling progress is made during this period of time because the window mill is attempting to cut the wall of the casing with essentially zero rotation at the center of the window mill.

It is advantageous for all of the mills to be full gage. One advantage is that with your window mill being full gage, the window hole will also be full gage when drilling is stopped with the assembly. If the window mill is undergauged, then when the drilling bit is run into the well, the full gage drilling bit is going to slow down as it cuts the under gage borehole to full gage. This then slows down the operator's ability to kick off and drill the new borehole with the drilling bit. The drilling bit must remount the bottom section of the borehole cut by the window mill. If the hole is full gage, they will be able to use the whip to help build an angle faster and apply weight to the drilling bit to drill laterally the new borehole. If they have to go down and ream out the hole, then they are much further down in the hole before they can kick out for their lateral drilling.

The window mill tapers conform to most of the ramp angles formed by the whipstock. For example, the largest diameter of the window mill forms a 3° cutting section matching the 3° section of the whipstock below the cylindrical portion of the whipstock. Of course, the 15° angle of the window mill is parallel to the 15° formed at the top of the whipstock. These matching angulations minimize damage to the whipstock face during the window cutting process thereby assuring a successfully cut window in the casing of the borehole.

After both the window mill and the second mill cut completely through the casing, the window mill is tripped out of the borehole. The sidetracking drilling operation then commences.

An advantage then of the present invention over the prior art is the use of a tapered window mill with a surface contour matching the ramp angle formed at the upstream end of the whipstock such that the mill is forced into the casing immediately after the window mill is released from the whipstock without damage to the whipstock.

Another advantage of the present invention over the prior art is the formation of angled and parallel ramp surfaces formed on the whipstock to facilitate and enhance the cutting action of both the window mill and the second mill, upstream of and spaced from the window mill.

Still another advantage of the present invention over the prior art is the use of an acutely angled ramp section at a point along the ramped whipstock surface when the center of the window mill reaches the inside diameter of the wall of the casing resulting in a slowdown in the window cutting operation. The "kick out" ramp more quickly moves the tapered window mill past this phase of the window cutting process thus speeding up the completion of the sidetrack window.

Other objects and advantages of the present invention will appear from the following description.

DESCRIPTION OF THE DRAWINGS

For a detailed description of a preferred embodiment of the invention, reference will now be made to the accompanying drawings wherein.

BRIEF DESCRIPTION OF THE PREFERRED EMBODIMENTS

Figure 1:
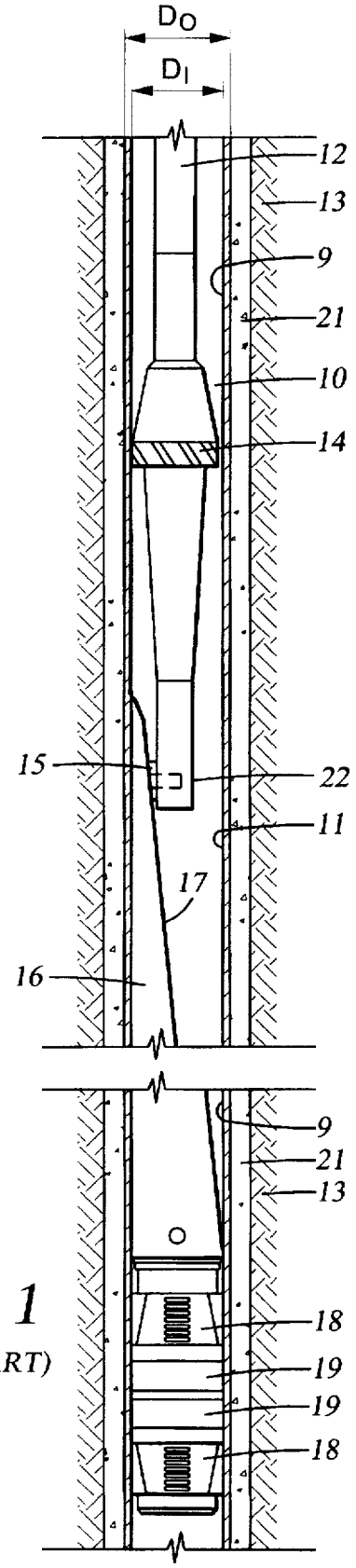
Fig. 1 (PRIOR ART)
FIG. 1 is a partial cross-sectional view of a prior art sidetracking operation depicting setting an anchor for a typical whipstock sidetracking system in a cased borehole.

Referring now to the prior art of FIG. 1, the casing sidetrack system generally designated as 10 consists of a drill collar 12 attached to a starter mill 14. The starter mill 14 is affixed to the end of the whipstock 16 through a shear bolt block 15. The whipstock 16 has an anchor 18 attached to the down hole end of the whipstock. The entire assembly 10 is tripped into a borehole 9 cased with steel pipe casing 11. The casing 11 has an interior annular wall having an inside diameter $D_I$ and an exterior annular wall having an outside diameter $D_O$. After the sidetracking system reaches a desired depth in the borehole, the whipstock 16 is oriented to a desired sidetrack angulation and set or anchored in the steel pipe casing 11. Casing 11 generally is made of steel but may be made of various other materials such as fiberglass for example.

Figure 2:
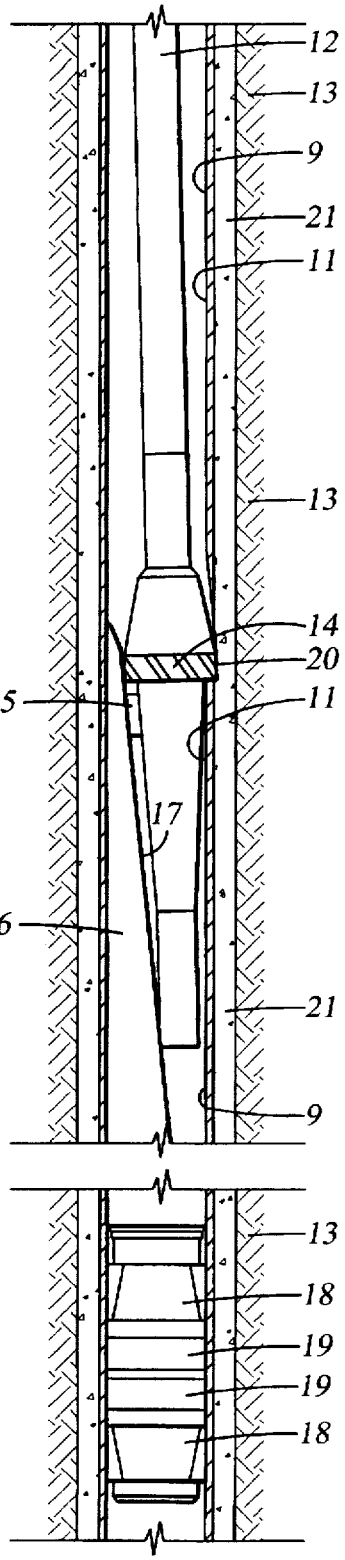
Fig. 2 (PRIOR ART)
FIG. 2 is a partial cross-sectional view of a first stage of the prior art sidetracking operation illustrating cutting a window section in a pipe casing with a typical starter mill.

With reference to the prior art of FIG. 2, once the system 10 is properly oriented and set in the casing 11, the starter mill 14 is released from the end of the whipstock 16 by breaking the solid shear pin 22 secured to the bolt block 15. The starter mill 14 is subsequently directed into casing 11 by shear bolt block 15 along ramped surface 17 formed by whipstock 16. The starter mill 14 then mills a window 20 through the wall of the casing 11. After the starter mill 14 begins the window 20, it is tripped out of the cased borehole 9.

Turning now to the preferred embodiments represented in FIGS. 3 through 8, FIGS. 3A and B illustrate a one trip mill assembly generally designated as 30 and a whipstock assembly generally designated as 60 that includes a whipstock 44. The mill assembly 30 includes a tapered window mill generally designated as 32. The mill 32 is attached to the bottom end of a shank or shaft 31. Upstream and spaced from the window mill is, for example, a second mill 33 also mounted to the shaft 31. The upstream end of the shaft 31 is either threadably connected to a drill string or threaded to another subassembly (see FIGS. 9 through 11). A tubular member 27 may form the shaft 31 on which mills 32 and 33 are mounted. Tubular member 27 may include a lower reduced diameter portion on which mill 32 is disposed with mill 33 being disposed on the full diameter of tubular member 27. This reduction in diameter provides flexibility between mills 32 and 33 during the milling process.

A third mill may be mounted to a shaft upstream of second mill 33. The third mill is desirable in some circumstances and will be discussed in detail with respect to FIGS. 9, 10 and 11.

Figure 3A:
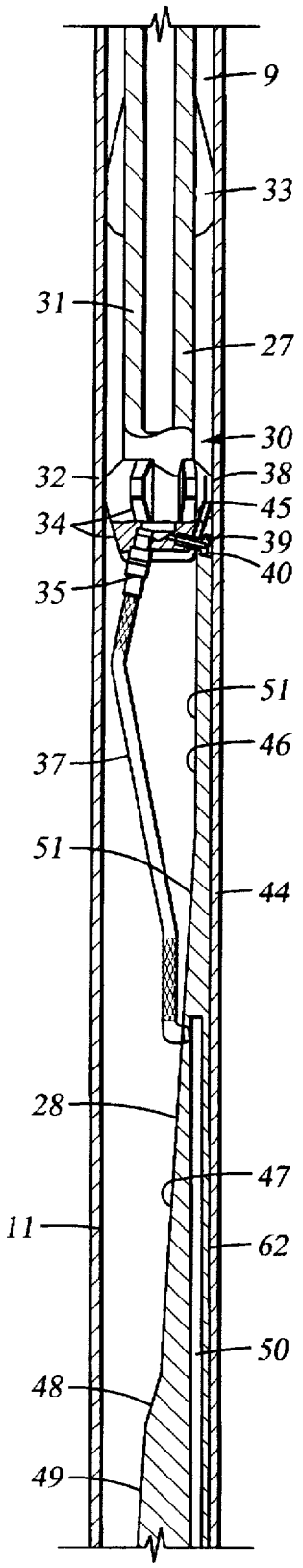
FIGS. 3A and B are a partial cross-section of a preferred embodiment of the invention whereby the top of the whipstock matches the taper of the window mill.
Figure 3B:
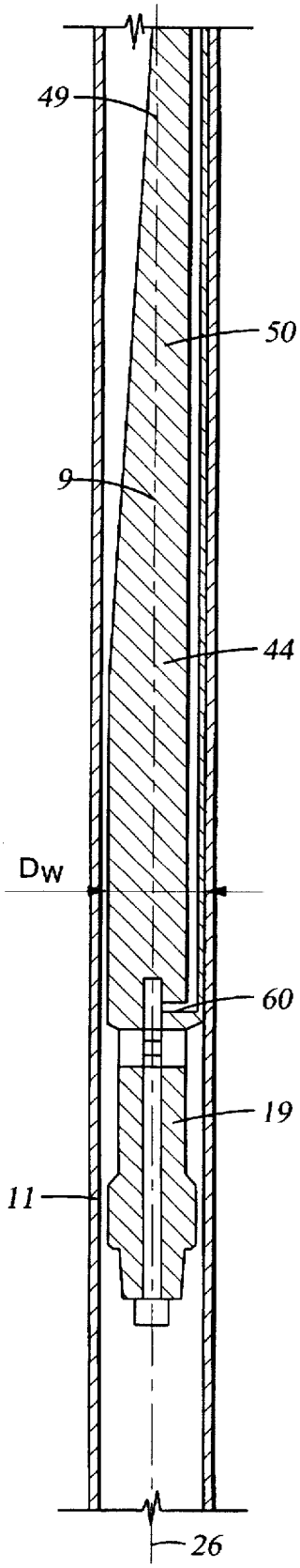
Figure 4:
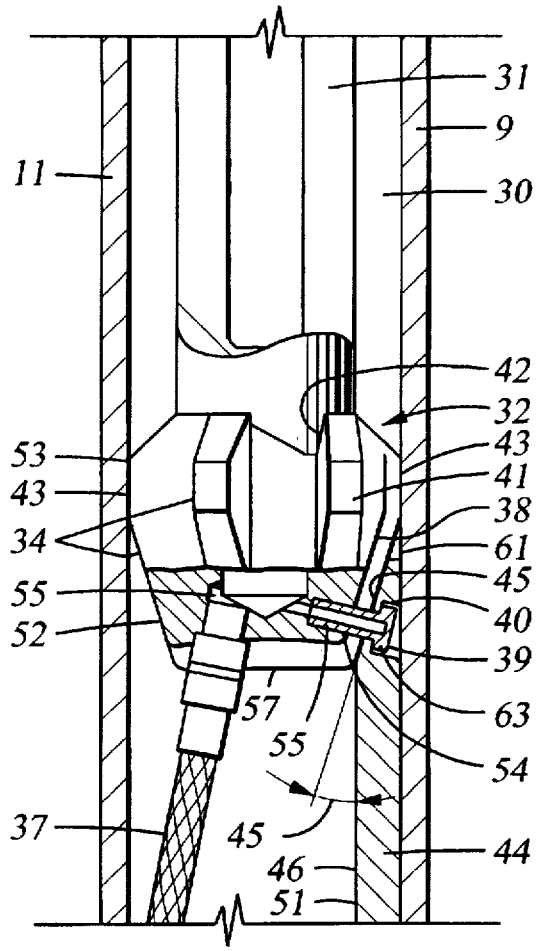
FIG. 4 is an enlarged partial cross-section of the tapered window mill illustrating the hollow shear pin attaching the tapered window mill to the parallel ramped surface formed adjacent the top of the whipstock.
Figure 5:
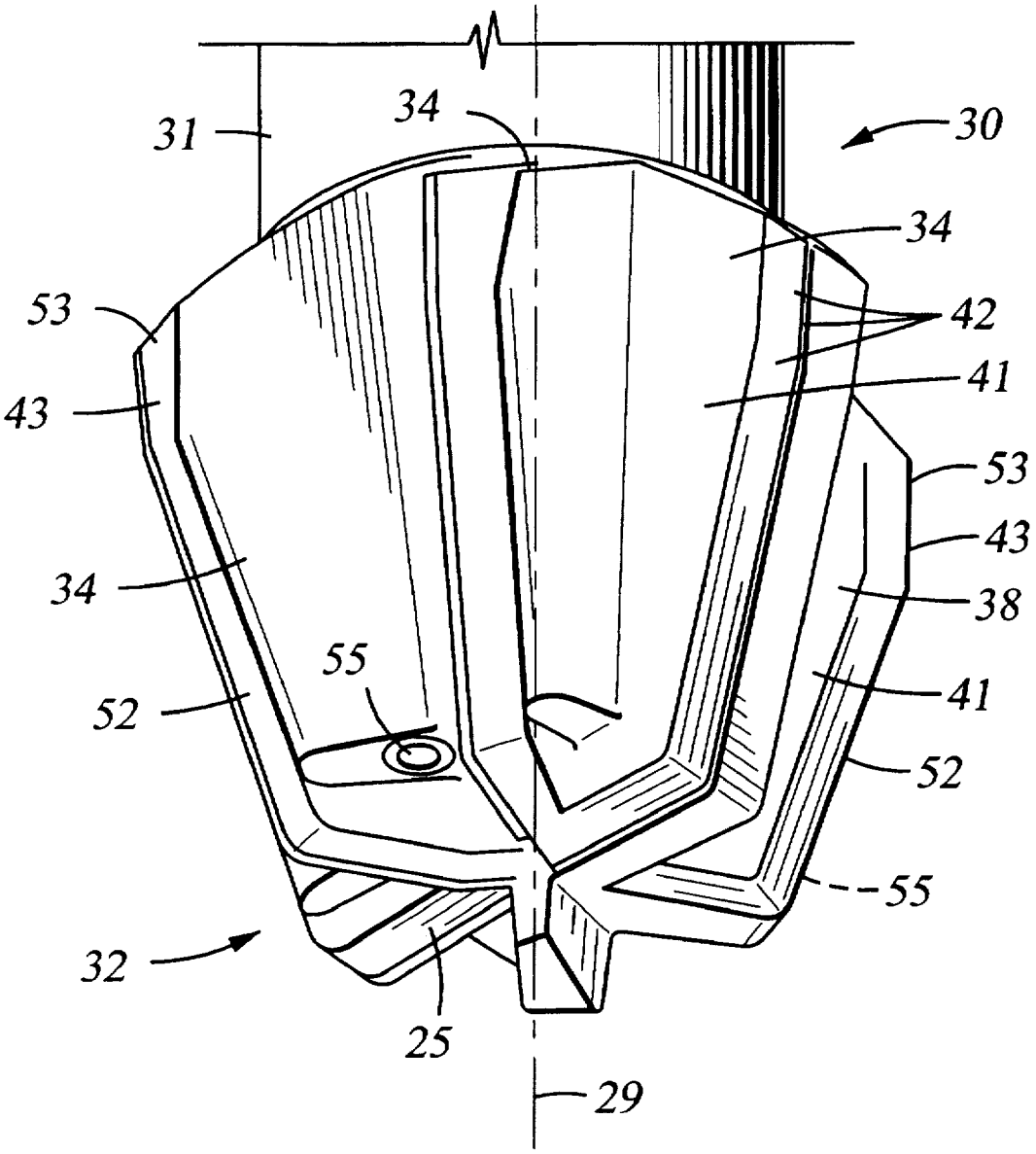
FIG. 5 is a perspective view of the tapered window mill with chip breaking cutter elements attached to the cutting face of each blade of the window mill.

Referring now to FIGS. 3 through 5, the window mill 32 includes a plurality of blades, such as blade 34, having a particular cutting profile. Each blade 34 has, for example, a multiplicity of cutting elements such as tungsten carbide cutters 42 with "chip breakers" formed on the face of the cutters. The chip breakers on the face of each cutter serves to break up the curled cuttings resulting from the window mill 32 cutting through the pipe casing 11 so that the cuttings may be transported up the drill string annulus by the mud circulated through the drill string. Without the chip breaker, the continuous cuttings create a "rats nest" downhole and cannot be easily removed. These highly effective cutters are manufactured by Rogers Tool Works, Rogers, Arkansas and are known as Millmaster. It would be obvious to utilize natural or polycrystalline diamond cutters (not shown) on the cutting blades 34 of the tapered window mill 32 without departing from the spirit of this invention.

Blade 38 immediately adjacent the parallel surface 45 of whipstock 44 is preferably wider to accommodate the shear bolt 39 threaded into the blade 38. The head of the shear bolt 63 is seated in the end of the whipstock 61 and the threaded shank 54 is threaded into blade 38. The shank 54 of the shear bolt is preferably hollow so that, once the bolt 39 is sheared, the shank 54 serves as a nozzle extension for nozzles 69 positioned at the base of shank 54 and at the entrance to conduit 37 that directs fluid to the whipstock anchor (not shown). It would be obvious however to utilize a shear bolt with a solid shank without departing from the scope of this invention.

The blades 34 of window mill 32 form a radial or lateral cutting surface which includes the profile of three cutting surfaces, namely a lower tapered cutting surface 52, a medial cutting surface 43, and a full diameter cutting surface 53. As defined, the radial cutting surface does not include the back tapered surface 55 above full diameter cutting surface 53. The tapered cutting surface of mill 32 is defined as that portion of the radial cutting surface which forms an angle with the axis 29 of mill 32 and as shown in the preferred embodiment, includes lower tapered cutting surface 52 and medial tapered cutting surface 43. It should be appreciated that although mill 32 is shown as having two tapered cutting surfaces 43 and 52, mill 32 may have a common taper or may have three or more different tapers.

The blades 34 also form a downwardly facing bottom cutting surface 57. Bottom cutting surface 57 is generally flat and circular having a diameter which is at least 30% and preferably 65% of the diameter of the full diameter cutting surface 53. This sized bottom cutting surface 57 provides stability to cutting operation of the mill 32.

The lower tapered cutting surface 52 of the window mill 32 is tapered, for example, 15° with respect to the axis 29 of the window mill 32 and the casing 11 in the borehole. The taper may be in the range of an angle A from 1 to 45° with respect to the axis 29. The height of tapered cutting surface 52 measured along the axis 29 is $L_3$. A shear pin 39 anchors the tapered window mill 32 through a connection in blade 38 of the mill 32 to profiled end surface 45 of whipstock 44. The end surface 45 of the whipstock 44 is profiled (angle 15°) to match the angle of the lower tapered end 52 of the window mill (15°) as hereinafter described.

The medial cutting surface 43 has a reduced taper of 3° which conforms to the 3° tapers on the profiled ramp surface 28 of the whipstock 44. The taper of surface 43 may be in the range of 1 to 15° with the axis 29. The height of medial taper 43 measured along the axis 29 is $L_2$.

The final full diameter cutting surface 53 extends vertically above medial cutting surface 43 and is parallel to the axis 29. The height of full diameter cutting surface 53 measured along the axis 29 is $L_1$. Full diameter cutting surface 53 is the full diameter of the mill 32, i.e. it is the major (largest) diameter of mill 32. It should be appreciated that the full diameter of mill 32 is preferably at least 75% or greater of the full diameter of casing 11 or of the maximum diameter to which the final sidetracked borehole will be completed and still more preferably is substantially full gauge. Full gauge is defined as the maximum diameter of a mill which can pass down through the casing 11.

The full diameter cutting surface begins at the first full diameter of the mill 32 as one moves 5 down the profile of the mill 32 from top to bottom. This is the first point where the mill 32 reaches its full diameter. In the preferred embodiment, the full diameter is below tapered back surface 55. The height of the radial cutting surface is the distance from the top of the full diameter cutting surface 53, i.e. the top of the largest diameter surface of mill 32, to the bottom of the tapered cutting surface adjacent downwardly facing bottom cutting surface 57. This height equals $L_1+L_2+L_3$.

The tapered cutting surface, i.e. lower tapered end 52 and medial cutting surface 43, are under full diameter since their diameter is less than that of full diameter cutting surface 53. It is preferred that the height of the full diameter cutting surface 53 of the mill 32 be at least 3% and no more than 70% of the radial cutting surface of mill 32. Thus, $L_1$ is less than 70% of the sum of $L_1+L_2+L_3$. It is even more preferred that the height of the tapered cutting surface be greater than the height of the full diameter cutting surface of mill 32. Stated differently, the tapered cutting surface, i.e. $L_2+L_3$, be at least 50% of the total radial cutting surface height, i.e. $L_1+L_2+L_3$. Preferably the full diameter cutting surface 53 have a sufficient height so as to allow some wear on the full diameter blades 34 and still maintain full diameter cutting. Such sufficient height is approximately 3 to 20% of the total radial cutting height.

Referring now to FIGS. 3A and 3B, the whipstock 44 has a diameter $D_W$ which approximates the inside diameter $D_I$ of the interior wall of casing 11 which allows whipstock 44 to be lowered through cased borehole 9. Whipstock 44 also includes a profiled ramp surface 28 having a curved or arcuate cross section and multiple surfaces, each of the multiple surfaces forming its own angle with the axis 26 of whipstock 44. Profiled ramp surface 28 includes a starter surface 45 having a steep angle preferably 15°, a vertical surface 46 preferably parallel to the axis 26, an initial ramp surface 47 having a standard angle preferably 3°, a "kick out" surface 48 having a steep angle preferably 15°, and a subsequent ramp surface 49 having a standard angle preferably 3°. It should be appreciated that these angles may vary. For example, the starter ramp surface 45 may have an angle A in the range of 1 to 45°, and preferably in the range of 2 to 30°, and still more preferably in the range of 3 to 15°, and most preferably 15°. The vertical surface 46 has a length approximately equal to or greater than the distance between mills 32 and 33.

Surface 45 may be heavily hardfaced with, for example, a composite tungsten carbide material 51 metallurgically applied to the ramp surface. Moreover, the entire profiled ramp surface 28 of the whipstock 44, exposed to the cutting action of the mills, may be hardfaced.

When the window mill 32 is full gage, the "kick out" ramp surface 48 begins at that point on the initial 3° ramp surface 47 where the thickness of the ramp surface 47 is approximately equal to the radius of the whipstock 44. In other words, the radial distance between that point on surface 47 and the inside diameter $D_I$ of the wall of the casing 11 should be approximately the same or slightly greater than the radius of the window mill 32. This ensures that "kick out" ramp surface 48 will increase the rate of deflection of the window mill 32 just before the center 25 of the bottom cutting surface 57 of window mill 32 reaches the inside diameter $D_I$ of the wall of the casing 11. The "kick out" ramp surface 48 forms an accelerator ramp which exerts a lateral force to the window mill 32 and greatly increases the rate of deflection of the window mill 32 into the wall of the casing 11. Although the preferred angle of "kick out" surface 48 is 15°, the angle may be from 10 to 45°. It should be appreciated that the kick out ramp surface 48 may be used in constant angle whipstocks such as a whipstock having a standard ramp surface of, for example, 2 to 3°, with the "kick out" ramp surface having a substantially greater ramp angle located at approximately the mid-whip position of the whipstock thereby creating a jog or deviation in the otherwise constant angle of the whipstock. The use of the "kick out" ramp surface 48 allows the design of the window mill 32 to incorporate a lighter dressing which will increase formation ROP.

The backside 62 of the whipstock 44, especially adjacent the upper end 61 of the whipstock 44, is contoured to conform to the inside diameter $D_I$ of the interior wall of the pipe casing 11 for stability of the top of the whipstock 44. The opposite lower end of the whipstock 44 is secured to a, for example, hydraulically actuated anchor (not shown). A typical anchor is shown in U.S. patent application Ser. No. 572,592 filed Dec. 14, 1995, incorporated herein by reference.

The mill 32 and whipstock 44 of the present invention are configured such that the mill 32 tends to cut the wall of the casing 11 and not the whipstock 44. To achieve this objective, various factors are taken into consideration including the contact area and contact stress between the mill 32, casing 11 and whipstock 44 and the cutability of the metal of the casing and of the metal used for the whipstock 44. Various ones of the physical properties of the materials of the casing 11 and whipstock 44 determine their cutability, i.e. their resistance to cutting. Cutability is not a particular property such as hardness but is a combination of properties. Cutability is developed through the test cutting of the materials for the whip 44 and for the casing 11. The lower the cutability number the harder the material is to cut.

To insure that the mill 32 cuts the casing 11 rather than the whipstock 44, the assembly must achieve the following formula:

$$C^*(AF_W/CA_W)=AF_C/CA_C$$

Where $CA_W$ is the contact area between the whipstock 44 and mill 32;

$AF_W$ is the applied force on the contact area $CA_W$ of the whipstock 44;

$CA_C$ is the contact area between the casing 11 and mill 32;

$AF_C$ is the applied force on the contact area $CA_C$ of the casing 11; and C is the ratio of the cutability of the whipstock 44 to the cutability of the casing 11.

Since contact stress CS is the applied force AF divided by the contact area CA, CS=AF/CA, and therefore $CS_W=AF_W/CA_W$ and $CS_C=AF_C/CA_C$. Substituting:

$$C^*(CS_W/CS_C)<1$$

Thus, the mill 32 will more easily cut the casing 11 before the whipstock 44 so long as the cutability ratio times the contact stress of the whipstock 44 divided by the contact stress of the casing 11 is less than one. One result of the contact stress equation is that it is preferred that the height of the full diameter of the mill 32 be less than the height of the under full diameter of the mill 32. As indicated previously, being full diameter does not mean the mill necessarily is full gauge.

Figure 4B:
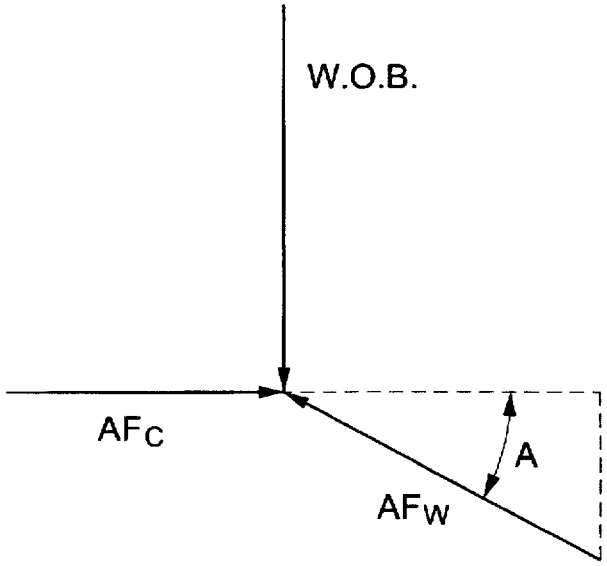
FIG. 4B is a free body force diagram showing the forces applied to the assembly of FIG. 4.
Figure 4A:
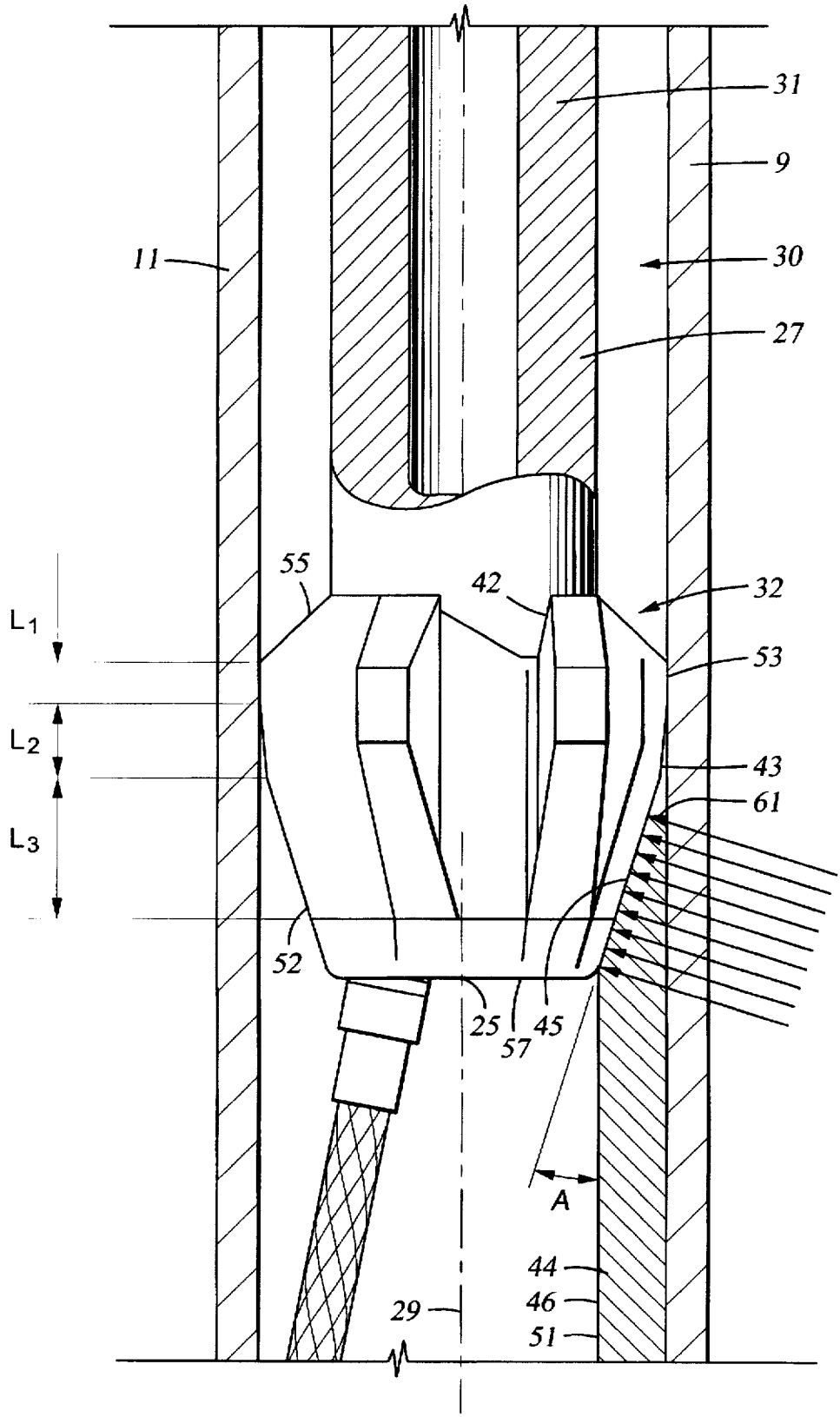
FIG. 4A is an enlargement of the tapered window mill of FIG. 4 showing contact areas between the mill, casing, and whipstock.

Referring now to FIG. 4B, making some simple assumptions, a free body force diagram is shown for the milling assembly of FIG. 4A. W.O.B. is the weight applied to the mill 32. The operator controls the weight on bit force. The applied force $AF_C$ of the casing 11 is shown applied to the full diameter cutting area 53. The applied force $AF_W$ of the whipstock 44 is shown applied to the lower tapered end 52 and is a component of the W.O.B. determined by the angle A. It can be seen that the contact stress is geometry dependent.

The smaller the ratio C of the cutability of the whipstock 44 to the cutability of the casing 11, the larger the ratio of the contact stresses can be between the mill 32, casing 11 and whipstock 44 and have the mill 32 cut the casing 11 better than the whipstock 44. Thus, it is preferred that the material of the whipstock 44 have a low cutability. An ideal situation would be to have the whipstock made of a material such as tungsten carbide while the casing 11 is made of steel to reduce the ratio C. Further, a lower cutability ratio allows the height of the full diameter cutting surface to be increased such that the height of the full diameter cutting surface may be greater than the height of the under gauge cutting surface. A higher cutability ratio will require a lower contact stress ratio to insure that the product of the ratios is less than one.

The tapered contact between the mill 32 and whipstock 44 provides a horizontal side component force which is applied to the casing 11. The angle of contact A between the whipstock 44 and the mill 32 determines this side component which equates to the horizontal component of the applied force on the contact area. Setting the sum of all forces to zero and assuming no resistance to bending, $AF_C$=W.O.B.*(1/Tan A) and $AF_W$=W.O.B.*(1/Sin A). The smaller the angle A, the larger the side load components $AF_C$ and $AF_W$. The object is to keep the contact area $CA_C$ between the casing 11 and the mill 32 to a minimum. As the milling progresses, $CA_C$ increases until the mill 32 reaches the outside wall of the casing 11. Once the mill 32 breaks through the casing 11, the contact area $CA_C$ begins to reduce.

Referring again to FIG. 4A, the equation may be applied to the preferred embodiment. If both the materials of the whipstock 44 and the casing 11 are assumed to be the same, then the cutability ratio C is 1 and no longer is a factor in the equation. If C is 1, then the contact stress CSw of the whipstock 44 must be less than the contact stress $CS_C$ on the casing 11 to prevent the mill 32 from cutting away the whipstock 44.

Applying the equation to FIG. 4A, and assuming a W.O.B. of 5000 lbs and an angle A of 15°, then $AF_C$=18,660 lbs and $AF_W$=19,319 lbs. If $CA_W$=10 in$^2$ and $CA_C$=5 in$^2$, then $CS_C$=3732 psi and $CS_W$=1932 psi. Inserting these into the equation, then $C^*(CS_W/CS_C)=1^*(1932/3732)=0.5<1$.

Figure 14:
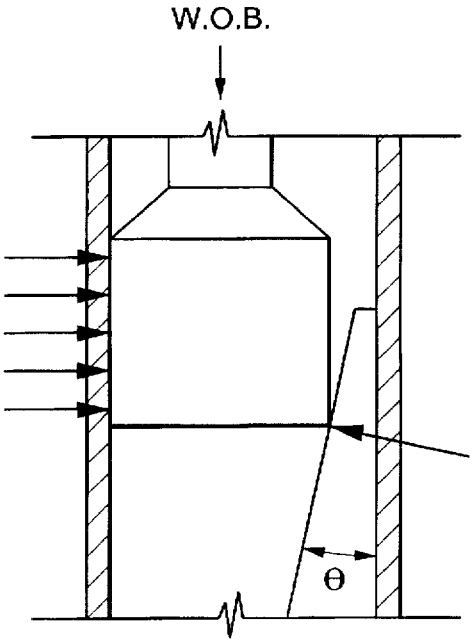
Fig. 14 (PRIOR ART)
FIG. 14 is a diagrammatical representation of a prior art square bottom mill showing contact areas.

Referring to FIG. 14, there is shown a prior art mill. Again assuming W.O.B. is 5000 lbs but with a square bottom mill and a whipstock with a taper of 3°. Calculating the applied forces, $AF_C$=95,406 lbs and $AF_W$=95,537 lbs. With $CA_C$=10 in$^2$ and $CA_W$=1 in$^2$, then $CS_C$=9,541 psi and $CS_W$=95,537 psi. Inserting these into the equation, then $C^*(CS_W/CS_C)=1^*(95,537/9,541)=10>1$. With the ratio of the contact stresses being greater than 1, the prior art square bottom mill will cut the whipstock rather than the casing.

The preferred angle A will vary depending upon various factors including the cutability of the casing 11 and whipstock 44. By making the contact area between the mill 32 and the whipstock 44 large, the contact stress between the mill 32 and whipstock 44 is low. The objective is to achieve a contact stress ratio which is as low as possible. Any ratio less than 1 will accomplish the objective of cutting the casing 11 over the whipstock 44.

The present application is directed to the interaction of the mill 32, whipstock 44, and casing 11. One objective is to maximize the contact area between the mill 32 and the whipstock 44 and to minimize the contact area between the mill 32 and the casing 11 during critical stages of the milling operation. It was intended that the contract stresses on the casing 11 be higher so that the casing 11 would be cut by the mill 32 rather than the mill 32 cutting away the whipstock 44. Thus, the objective is to have sufficient contact area between the mill 32 and whipstock 44 to ensure that the contact stresses between the mill 32 and the casing 11 are greater causing the casing 11 to be cut rather than the whipstock 44.

Figure 15:
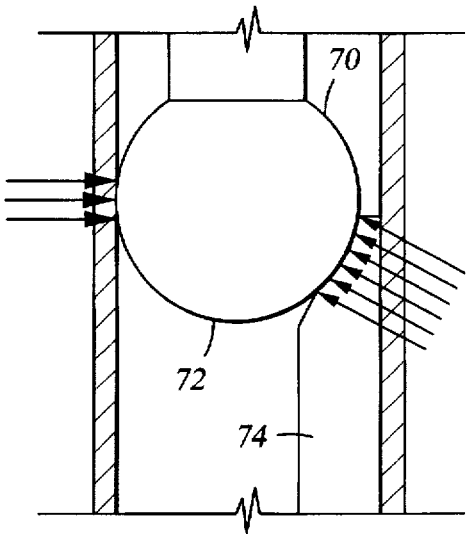
FIG. 15 is a diagrammatical representation of an alternative side tracking system of the present invention with a mill having a rounded profile.

The mill 32 of the present invention may have various cross sectional cutting profiles so long as the contact areas with the casing 11 and whipstock 44 produce the preferred contact stresses. The objective is to configure the contact stresses between the mill 32, casing 11, and whipstock 44 so that the casing 11 will be cut away. Referring now to FIG. 15, there is shown a mill 70 having a rounded cutting surface 72. Assuming the cutability ratio to be one, so long as the contact stress between the mill 70 and whipstock 74 is greater than the contact stress between the mill 70 and casing 11, the casing 11 will be cut more than the whipstock 74.

In operation, the assembly 30 is lowered into cased borehole 9 to a predetermined depth. The whipstock 44 is then rotated to a desired sidetrack direction followed by hydraulically actuating the anchor (not shown) by directing drilling fluid or "mud" down the drill string 12 under high pressure through flex conduit 37 connected to a coupling 35 on the end of the window mill 32. Coupling 35 includes a weakened area therearound such as a reduced diameter portion allowing coupling 35 to break cleanly from the mill 32. The pressurized fluid then enters conduit 50 formed in the whipstock 44 and from there to a connecting member 19 and then to the anchor to extend the pipe gripping elements within the anchor (not shown).

Referring particularly to the enlarged FIG. 4A, once the anchor is set, weight/tension is applied to the drill string 27 imparting sufficient forces to break the shear pin 39 freeing the tapered window mill 32. The mill 32 is then rotated and lowered to make contact with the whipstock 44 and casing 11. The relatively steep profiled angle A (15°), formed in surface 45 of the whipstock 44, immediately provides a lateral force to the tapered end 52 of the mill 32 thus forcing the rotating mill 32 into the interior of the wall of the pipe casing 11 to start forming a first window 20A in the pipe casing 11.

Figure 6B:
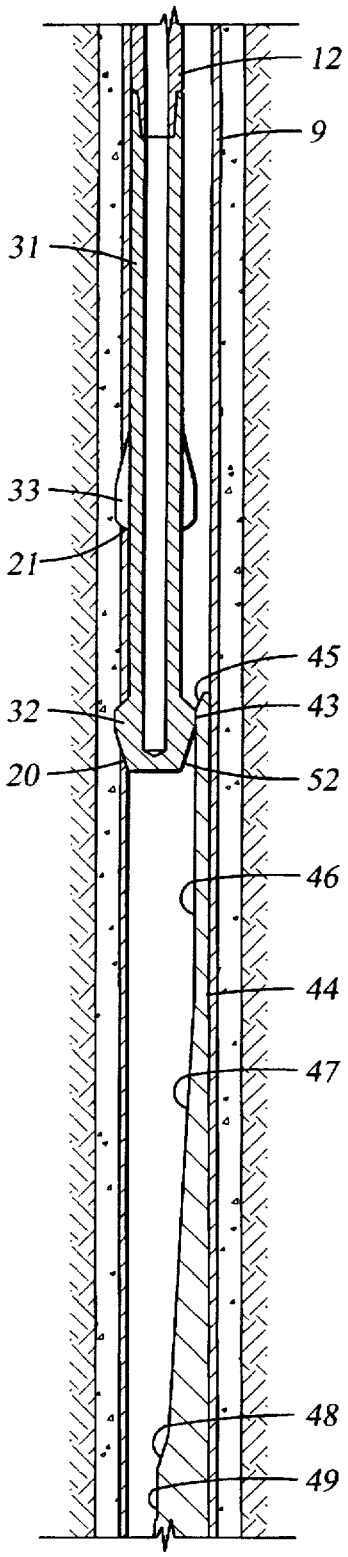
FIG. 6 is a partial cross-section of the one trip sidetrack window cutting apparatus wherein the mill is sheared from the top of the whipstock and is moved laterally through the casing by 15° ramp angle formed in the top of the whipstock.

The upstream second mill 33, which may be tear drop in shape, is also forced into the wall of the pipe casing 11 thereby simultaneously cutting a second window 20B above the first window 20A formed by the window mill 32. The surface 46 formed by the whipstock 44 below angled surface 45 is preferably parallel to the axis of the pipe casing 11 while the window mill 32 and the second mill 33 cut simultaneous windows 20A and B (FIG. 6).

Figure 7B:
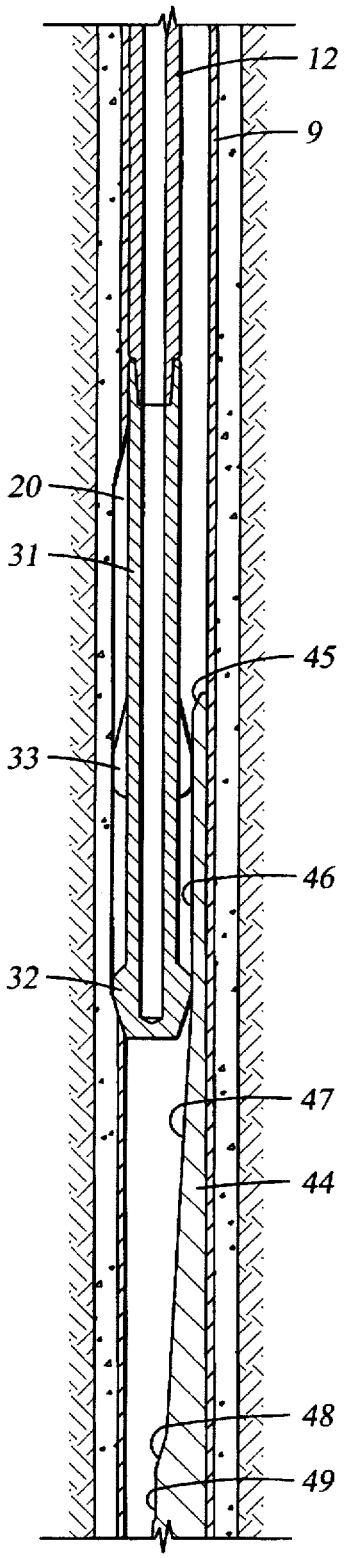
FIGS. 7 are a partial cross-section of the window mill and upstream "tear drop" cutter cutting the window in the pipe casing. The ramp section immediately below the 15° ramp formed in the whipstock is parallel to the axis of the pipe casing while the tear drop cutter completes its initial cut in the window from its entry into the casing to its intersection with the cut made by the tapered window mill.

With specific reference to FIG. 7, once the upstream window 20B (cut by the second mill 33) merges with the downstream window 20A started by the window mill 32, cutting forces are lessened. The ramp surface 47 formed by the whipstock 44 below the parallel surface 46 then transitions into a ramp with a 3° angle.

Figure 8B:
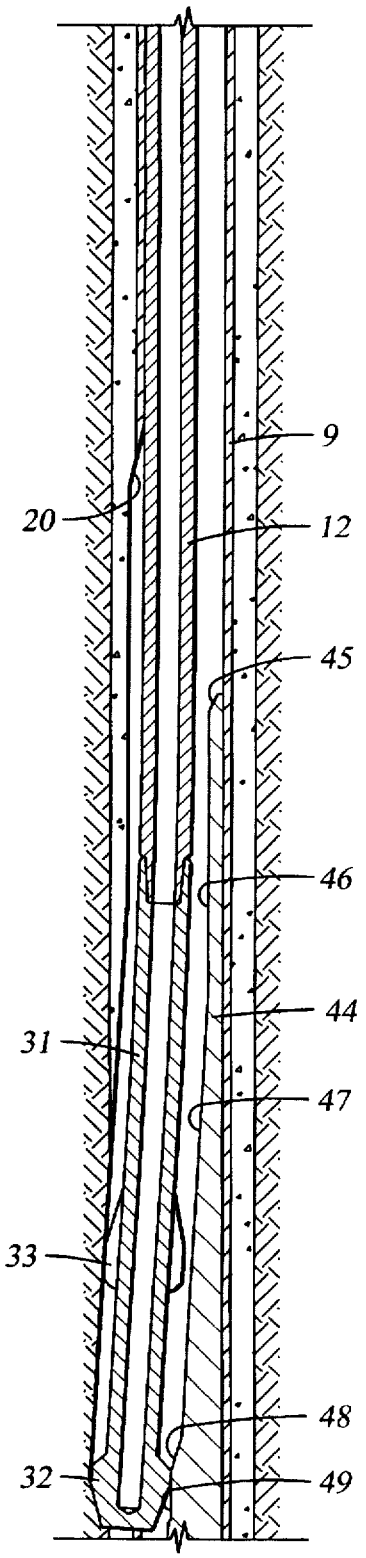
FIGS. 8 are is a partial cross-section of the window mill contacting a second "kick out" ramp formed in the 3° ramp portion of the whipstock, the kick out ramp serves to force the window mill out of the casing so that it will complete the window more efficiently.

Referring now to FIG. 8, when the center 25 of the bottom cutting surface 57 of the window mill 32 starts cutting at the inside diameter of the wall of the casing 11 as the window milling apparatus progresses down the whipstock 44 and out through the window 20 cut into the pipe casing 11, the cutting or pipe milling action is slowed considerably. At this point the "kick out" ramp 48 (15° as compared to the 3° ramp surface 47) "kicks" the window mill 32 out through the casing 11 for more efficient milling of the casing 11. Once the center 25 of mill 32 passes from the interior to the exterior of the casing 11 and this part of the window milling process is overcome, the ramp 49 below the kick out ramp 48 reverts back to the standard 3° ramp angle surface 49.

Figure 9A:
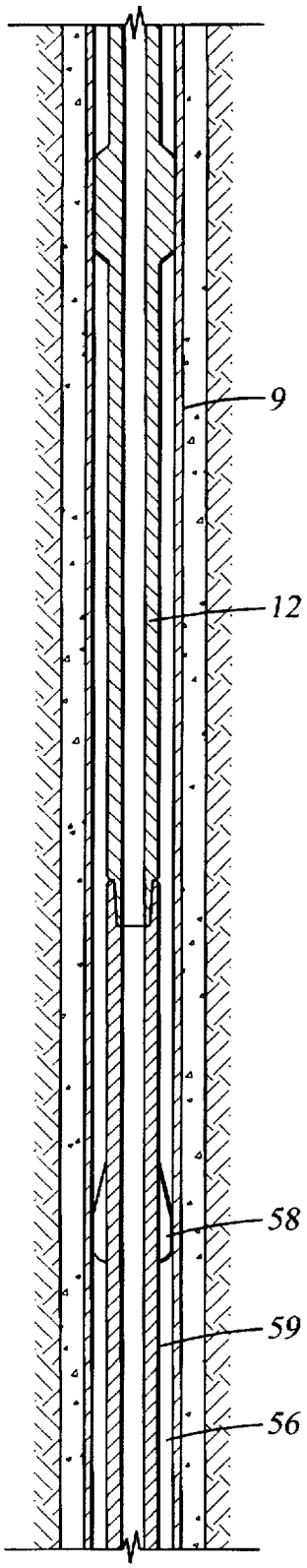
FIGS. 9A and B are a partial cross-section of an alternative window cutting apparatus identical to the apparatus shown with respect to FIGS. 6 through 8 with the exception of a "watermelon" mill positioned upstream of the tear drop mill.
Figure 9B:
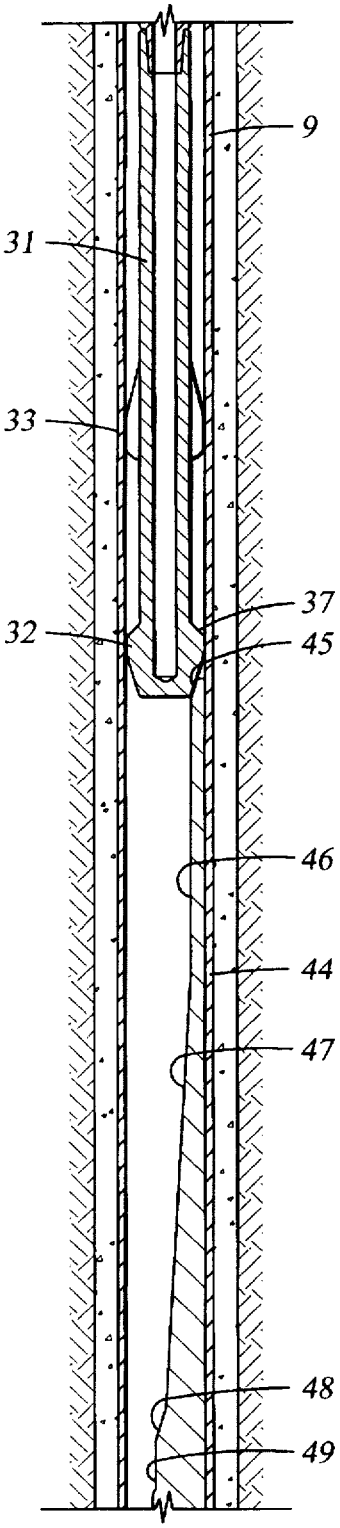

An alternative embodiment is illustrated in FIGS. 9 through 12. A second subassembly generally designated as 56 is positioned intermediate mill assembly 30 and the drill string 12. A third mill 58, such as a watermelon mill, is spaced between the male and female ends of the shank or shaft 59 (FIG. 9).

Figure 10A:
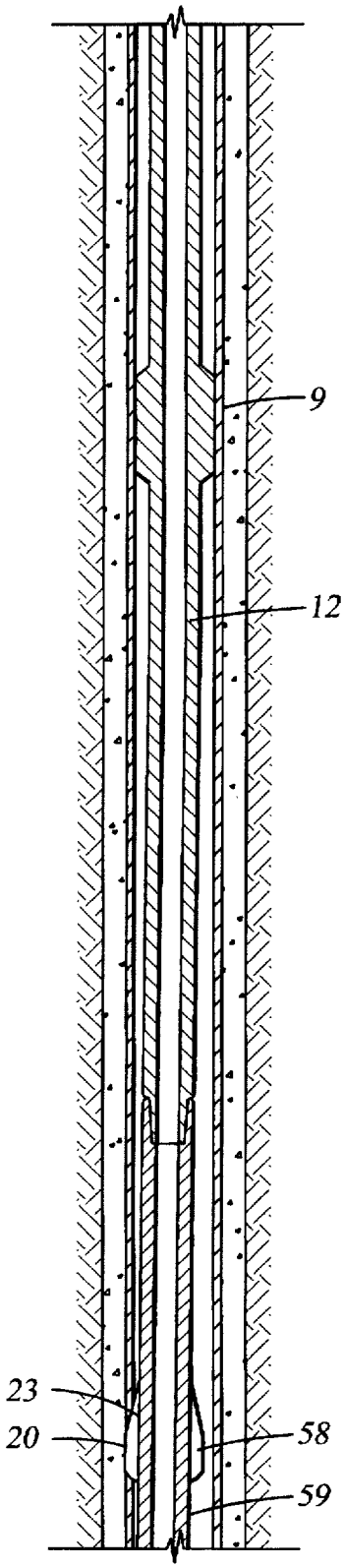
FIGS. 10A and B are a partial cross-section of the alternative apparatus illustrating the watermelon mill starting its cut into the pipe casing above the window started by the downstream mills.
Figure 10B:
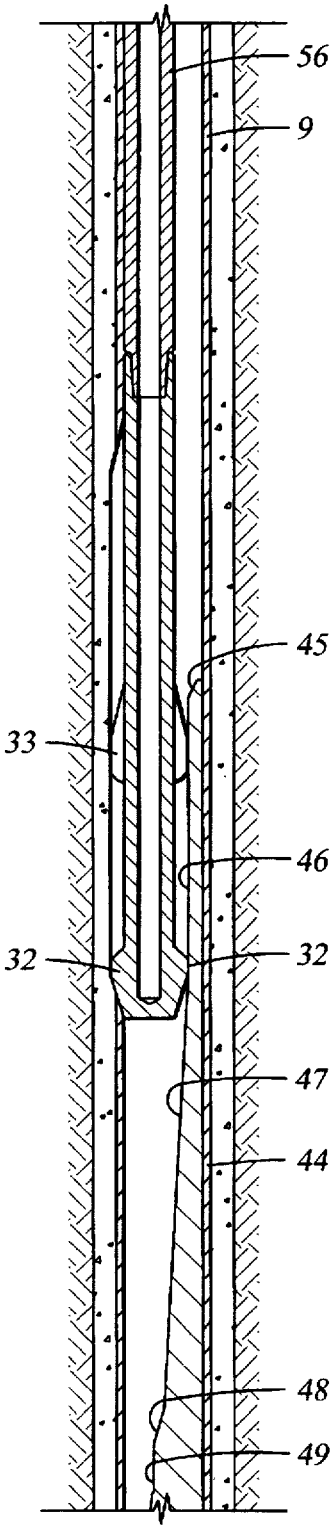

FIG. 10 illustrates the third mill 58 having generally the same diameter as the window mill 32 and second mill 33 and serves to both lengthen the window 20 penetrating the casing 12 above the window 20 cut by the window and second mills 32, 33. It is preferred that all three mills 32, 33 and 58 be full gage.

Figure 11A:
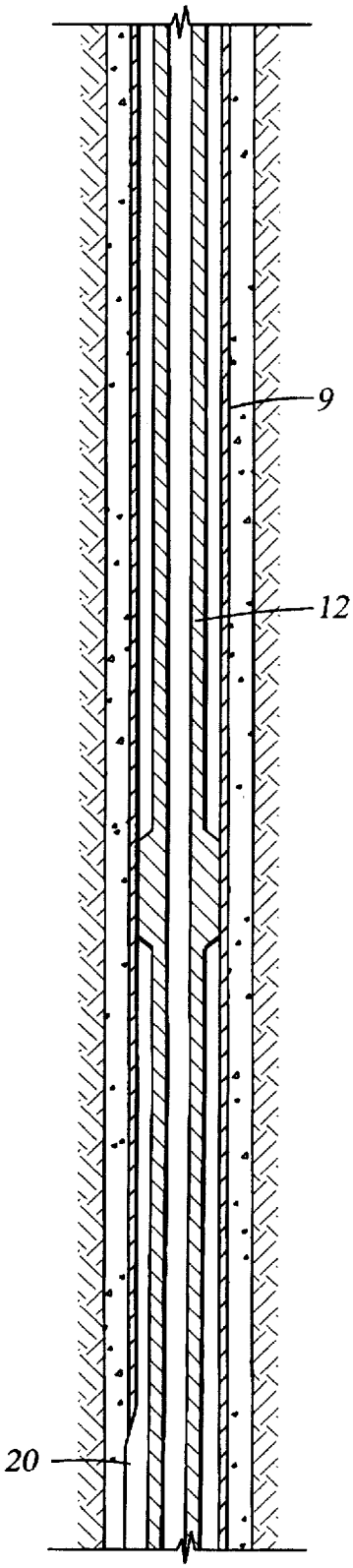
FIGS. 11A and B are a partial cross-section of the alternative apparatus after the window, tear drop and watermelon mills have cut an elongated window in the casing.
Figure 11B:
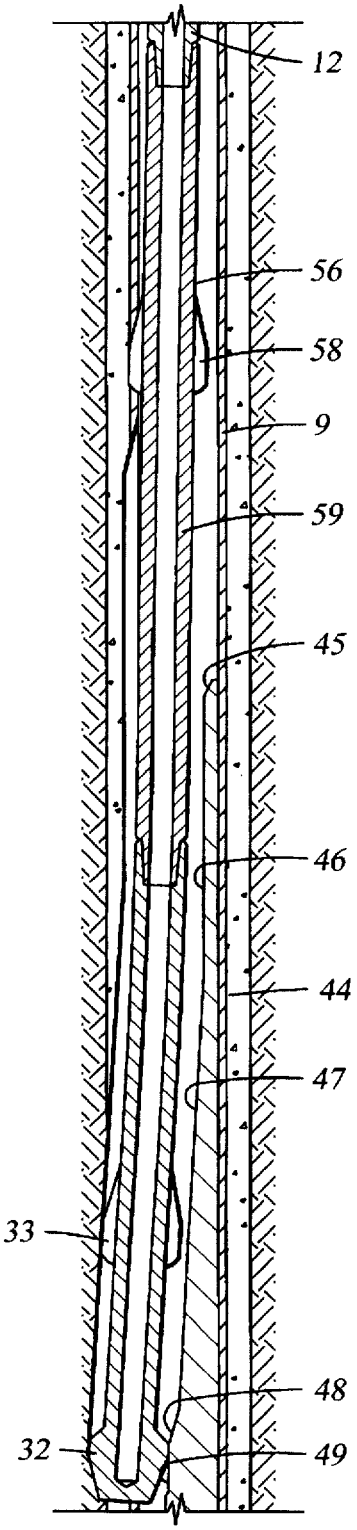

The third mill 58 also serves to dress the window opening 20 as shown in FIG. 11 for easy transition of the following side track drill bit assembly.

The elongation of the window 20 by the watermelon mill 58 is desirable to facilitate sidetracking drill bit assemblies that are relatively stiff and the angle of the side track borehole is slight. A longer window then would be necessary.

Where the side track angle is more severe and the drill bit side track assembly is relatively limber, a shorter window will suffice and the watermelon assembly 56 is omitted from the window cutting apparatus as is shown with respect to FIGS. 3 through 8.

Upon assembly, mill assembly 30 is connected to whipstock assembly 60 by shear bolt 39 with the lower tapered end 52 of window mill 32 being engagingly disposed against starter surface 45. Further, hydraulic hose 37 is connected to assemblies 20, 30.

In operation, the whipstock assembly 20 and mill assembly 30 are connected to the lower end of a drill string 12 and lowered into cased borehole 9 as shown in FIGS. 9A and B. Once the desired depth is reached for the secondary or deflection bore, the whipstock assembly 20 is aligned and oriented within the cased borehole 9 and the anchor is set thereby anchoring the whipstock assembly 20 within the cased borehole 9 at the desired location and orientation. Tension is then pulled on drill string 12 to shear shear bolt 39.

The mill assembly 30 is then rotated and lowered on the drill string 12. The complimentary lower tapered end 52 on the rotating window mill 32 cammingly and wedgingly engages starter surface 45 on whipstock 44 thereby causing the window mill 32 to kick out and engage the wall of the casing 11 thereby forcing the cutting elements 34 into milling engagement. As the window mill 32 rotates and moves downwardly, the window mill 32 continues to be deflected out against the wall of the casing 11 and eventually punches through the wall of the casing 11. It is important that the starter surface 45 and its center line match that of the initial surface 52 on the window mill 32. The angle of tapered end 52 and starter surface 45 may be up to 45°.

Once initial punch out has been achieved, weight on the drill string 12 is required to push the window mill 32. It is the "punch through" of the window mill 32 that is the most important cutting. Once the window mill 32 punches through the wall of the casing 11, a ledge is created allowing the whipstock 44 to then guide the mill assembly 30 through the window 20 cut in the wall of the casing 11.

This initial guidance of the starter surface 45, the large contact area, and the hard facing 51 ensures that the whipstock 44 is not badly damaged by the window mill 32 and that the window mill 32 properly initiates the required window cut. It is important to deflect the window mill 32 away from the ramp surface 20 of the whipstock 44 to avoid the window mill 32 from milling the whipstock 44.

Referring now to FIGS. 10*a* and B, once the initial punch out is made through the wall of the casing 11 by the window mill 32, the window mill 32 has past the starter surface 45 and is adjacent the straight surface 46 which allows the mill 32 to run along a straight track. Once the window mill 32 moves past the starter surface 45, window mill 32 continues to mill the wall of the casing 11 while the second mill 33 expands the window in the wall of the casing 11 previously cut by the window mill 32. As the second mill 33 follows behind the window mill 32 and begins to cut into the wall of the casing 11, there is formed an uncut portion of the casing 11 between the two mills 32, 33 which has not yet been milled. As the window mill 32 is lowered downwardly adjacent to straight surface 42, the second mill 33 cuts the unmilled portion of casing 11 which extends between mills 32, 33.

If the second mill 33 is deflected into the casing 11, then that portion of tubular member 27 between the window mill 32 and pilot mill 33 may engage the uncut portion of the casing wall which has not yet been milled out. If the window mill 32 maintains the steep angle of the starter surface 45, it is possible that that portion will engage the uncut portion of the wall of the casing 11 and prevent the mills 32, 33 from cutting the wall of the casing 11. It is possible that the mill assembly 30 could bind and hinder further milling. This is prevented by straight surface 46 which has a height substantially equal to or greater than the distance between mills 32 and 33.

Upon the window mill 32 moving past the straight surface 46, any uncut portion of the casing wall between the mills 32, 33 has now been cut by the second mill 33. At this point, the medial surface 43 of window mill 32 engages the ramp surface 47 and the window mill 32 is again deflected outwardly against the wall of casing 11 to enlarge the window 20 and is guided by the surface 47 into the wall of the casing 11 without causing any damage to the whipstock 44. Now that the window mill 32 has punched through the wall of the casing 11, it begins cutting into the cement. The second mill 33 is now passing along the straight surface 46 and cutting the window 20 that has already been started by the window mill 32 to make the window wider. As can be appreciated, watermelon mill 58, following the second mill 33, also begins cutting and widening the window 20 through casing 11. There may be one or more additional watermelon mills above the first watermelon mill 58. The purpose of the watermelon mills is to elongate the top of the window 20 in the casing 11 and clean up the window 20 particularly if there has been a ledge created.

Referring now to FIGS. 11A and B, upon completing the milling along the surface 47, the casing wall will be underneath the window mill 32 and the center 25 of the window mill 32 is approaching the inside diameter of casing 11. At this point, the window mill 32 engages kick out surface 48 to assist the crossing of the wall of the casing 11. The steeper angle on surface 48 causes the center 25 of window mill 32 to more quickly kick out and radially pass from the inside diameter to the outside diameter of the wall of casing 11. The second mill 33 and watermelon mill 58 are following and expanding and clearing the window in the wall of the casing 11. The mill assembly 30 drills faster into the formation once the window mill 32 completely passes the cased wall and into the formation.

The kick out wedge surface 48 is a second steep surface to assist in moving the window mill 32 from the inside diameter to the outside diameter of the wall of the casing 11. When the center line 25 of the window mill 32 is sitting on the wall of the casing 11, the window mill 32 is essentially at zero rotation. The purpose for the kick out surface 48 is to reduce the drilling time required to cross the wall of the casing 11. The increased angle of surface 48 allows the window mill 32 to move quickly across the wall of casing 11. By increasing the angle between window mill 32 and whipstock 44, the cutting distance of the window mill 32 is shortened for the center line 25 of the window mill 32 to cross the wall of the casing 11.

Further, additional weight can be applied to the drill string 12 to increase the force on the window mill 32 and to cause the center 25 of the bottom cutting surface 57 of the window mill 32 to cross the casing wall more quickly. Once the center 25 of the window mill 32 crosses the wall of the casing 11, the window mill 32 goes back to the final three degree surface 49 departure to exit. This reduced drilling time and distance allows significant savings.

Upon the window mill 32 moving past the kick out surface 48, the center 25 of window mill 32 has passed outside of the wall of the casing 11 and is creating a diverted path to form a side track through the wall of the casing 11 and a window borehole in the formation. At this point, the medial surface 43 of window mill 32 engages the lower surface 49 of ramp surface 20 and the window mill 32 is deflected laterally to drill the window borehole. The window mill 32 is now being guided by the lower surface 49 into the formation. The window mill 32 in effect drills the window borehole for the drill bit so that the drill bit can get a faster start in drilling the new borehole.

The window 20 is cut substantially the entire length of the whipstock 44. Once the milling or cutting of the window is completed, the drill string 12 and mill assembly 30 are replaced by a standard drilling apparatus for drilling the new borehole.

Figure 13:
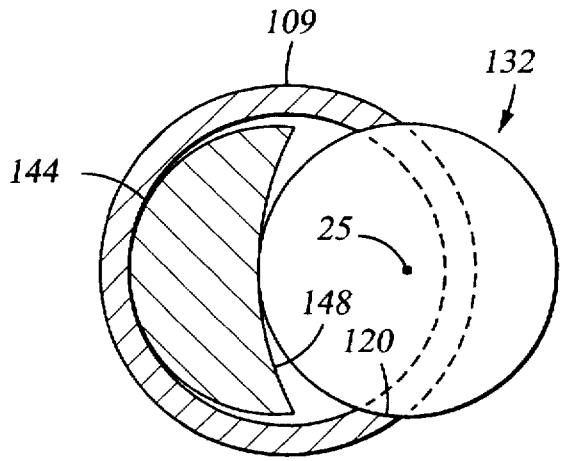
FIG. 13 is a view taken through 13—13 of FIG. 12.
Figure 12:
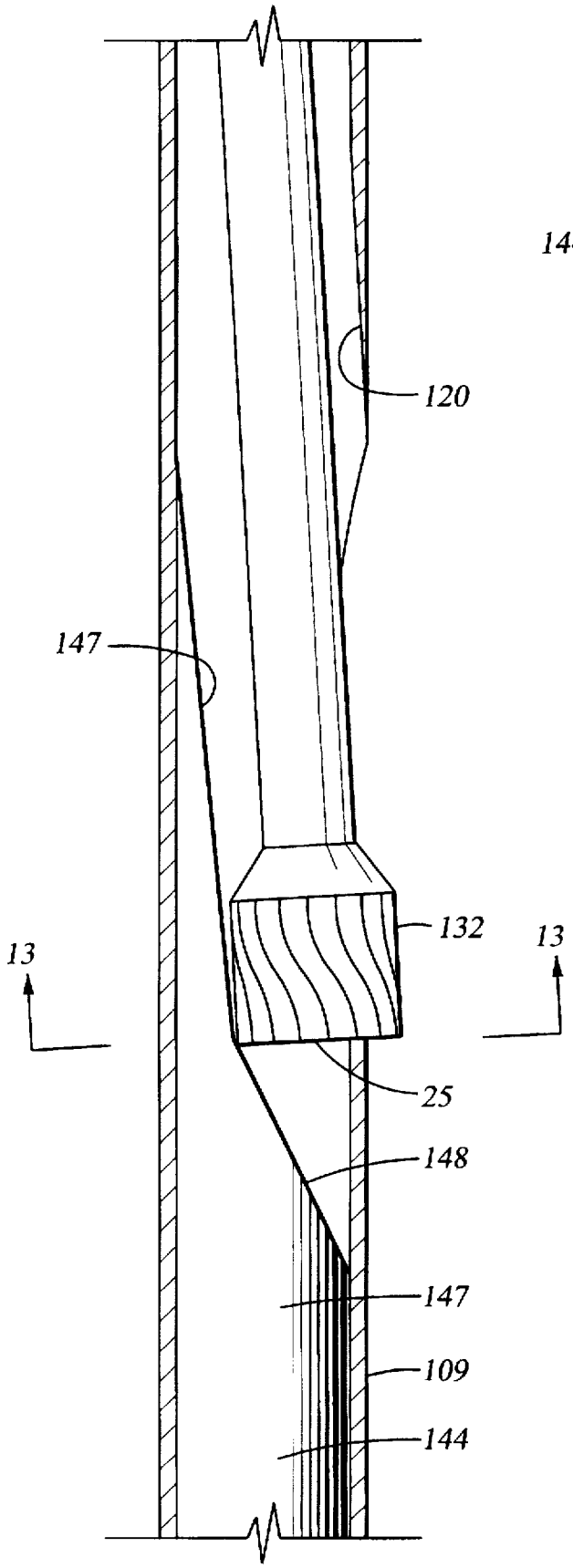
FIG. 12 is a partial cross-section of an alternative whipstock with a "kick out" ramp in the 3° ramp portion.

Turning now to the alternative embodiments of FIGS. 12 and 13, a whipstock generally designated as 144 has, formed on its 3° ramp surface 147, a kick out ramp 148.

The aggressive angle of the ramp 148 formed in the whipstock guide surface 147 enables the conventional window mill cutter 132 to quickly move beyond that part of the milling process which occurs when the center 25 of the mill 132 is passing over the wall of the casing 109 as heretofore described.

FIG. 13 illustrates the window mill 132 passing over the wall of the casing 109 as it progresses through window 120. The window mill 132 need not have a tapered end as does mill 32 in the embodiment of FIGS. 1–11. This mill 132 may have a leading end with an angle in the range of 0 to 45°.

The ramp angles for ramps 45, 48 and 148 may be from 1 to 45° with respect to the axis of the whipstocks 44 and 144 without departing from the scope of this invention.

Moreover, where parallel surfaces are mentioned such as blade surface 52 formed by tapered mill 32 and ramp surfaces 45, 48 and 148 formed by whipstock 44, these surfaces are considered "substantially" parallel when such surfaces are less than 3° from being exactly parallel.

It should also be noted that the pipe casing 11 lining the borehole 9 may be other than steel.

Moreover, there may not be any casing lining the borehole 9. Many of the unique features of this invention set forth above will still be advantageous in successfully drilling a deviated borehole in an existing earth borehole.

Figure 16A:
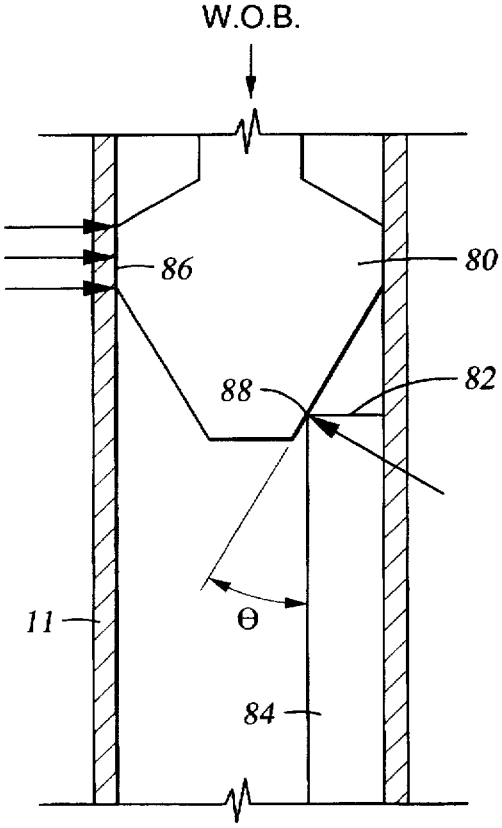
FIG. 16A is a diagrammatical representation of the mill of the present invention with a prior art whipstock having no ramp at its upper end.
Figure 16B:
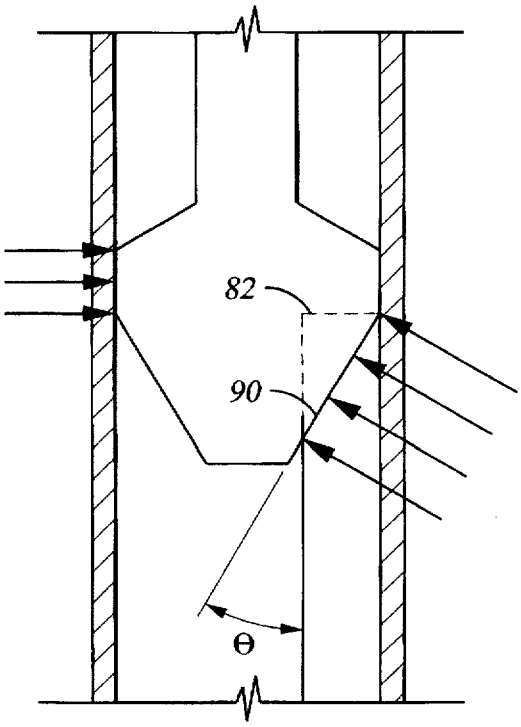
FIG. 16B is a diagrammatical representation of the mill of FIG. 16A with the tapered mill having cut a taper in the face of the prior art whipstock.

Referring now to FIGS. 16A and 16B, the tapered mill of the present invention may be used with practically any whipstock. Although it is preferred that the whipstock have a ramp which has substantially the same angle as the taper of the tapered cutting surface of the mill and that the ramp be of sufficient duration or length that it deflects the mill 32 through the casing 11, the tapered mill will cut its own contact area in the upper end of the whipstock so as to achieve a contact area as it progresses down the borehole that will cause the cutability ratio times the contact stress ratio to be less than one.

It should be noted that the contact area of the whipstock can be created by the mill itself even though there is no tapered surface on the whipstock. It suffices to say that the mill must be of a geometry such that it can in fact create the necessary surfaces on the whipstock. For example, the whipstock must have a sufficient thickness so as to allow the mill to cut the necessary contact area.

FIG. 16A illustrates a tapered mill 80, substantially identical to mill 32, in contact with the upper terminal end 82 of prior art whipstock 84. Although the upper terminal end of many prior art whipstocks has a small chamfer or taper, whipstock 84 is shown with a blunt upper terminal end 82 for purposes of illustration. It can be seen that there is only line contact between mill 80 and whipstock 84 such that the contact area 86 between the mill 80 and casing 11 is substantially greater than the line contact 88 between the mill 80 and whipstock 84. Thus, the contact stress ratio of the contact stress between the mill 80 and whipstock 84 and between the mill 80 and casing 11 will be over one and therefore the mill 80 will cut the whipstock 84 rather than the casing 11.

Since the upper terminal end 82 of the whipstock 84 is squared off, when the mill 80 is brought into contact with the top of the whipstock 84, the mill 80 will mill the whipstock 84 as mill 80 progresses downwardly thereby increasing the contact area between the mill 80 and the whipstock 84. Initially, the mill 80 only contacts the whipstock 84 at a very small contact area. Therefore, the mill 80 will cut the whipstock 84 rather than the casing 11. The mill 80 will continue to cut the top of the whipstock 84 until the cutting of the whipstock progresses a sufficient amount to increase its contact area such that the mill 80 initiates the cutting of the casing 11. Eventually the mill 80 will cut a taper into the whipstock 84 as shown in FIG. 16B. It should be appreciated that the contact stresses, and thus the contact stress ratio, will change as the mill 80 progresses downwardly in the borehole 9. The contact stress ratio will decrease as the mill 80 enlarges its contact area with the whipstock 84. The mill 80 always mills the casing 11 to some degree while in engagement with the casing 11, but as the contact area of the mill 80 and whipstock 84 increases, the cutting of the casing 11 by the mill 80 is increased and the cutting of the whipstock 84 is reduced.

Referring now to FIG. 16B, the mill 80 is shown having cut a taper or ramp 90 in the surface of whipstock 84 such that the contact area has now increased and the contact stress ratio is less than one whereby the mill 80 will begin to cut the casing 11 rather than the whipstock 84. The previous position of the upper terminal end of the whipstock 84 is shown in dotted lines. As mill 80 progresses downwardly and is deflecting outwardly by whipstock 84, the window is cut in casing 11.

There are many configurations and profiles which will achieve the objectives of the present invention, not just those shown in the present application.

It will of course be realized that various modifications can be made in the design and operation of the present invention without departing from the spirit of the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed:

1. A side track cutting apparatus for cutting a secondary borehole through the wall in an existing borehole, comprising:

a cutting tool affixed to the end of a shaft, the cutting tool having a full diameter cutting surface and a reduced diameter cutting surface; and a whipstock having a ramp;

said reduced diameter cutting surface contacting said ramp at a first contact area and said full diameter cutting surface contacting the interior of the wall of the borehole at a second contact area; and said first contact area being greater than said second contact area.

2. The apparatus of claim 1 wherein a weight is applied to said cutting tool creating a first contact stress between said reduced diameter surface and said ramp at said first contact area and a second contact stress between said full diameter cutting surface and the interior of the wall of the borehole, the ratio of said first contact stress divided by said second contact stress being less than one.

3. The apparatus of claim 1 wherein said whipstock has a first cutability and the wall of the borehole has a second cutability and wherein a weight is applied to said cutting tool creating a first contact stress between said tapered cutting surface and said ramp at said first contact area and a second contact stress between said full diameter cutting surface and the interior of the wall of the borehole, a first ratio of said first cutability divided by said second cutability and a second ratio of said first contact stress divided by said second contact stress, said first ratio times said second ratio being less than one.

4. The apparatus of claim 1 wherein said reduced diameter surface has a first height and said full cutting surface has a second height, said first height being greater than said second height.

5. The apparatus of claim 1 wherein said reduced diameter surface has a first height and said full cutting surface has a second height, said first height being at least 30% of said first and second heights.

6. The apparatus as set forth in claim 1 further comprising a second mill, said window mill and said second mill being affixed to a shaft, the second mill being spaced upstream of the window mill, the second mill substantially simultaneously cutting into the casing when the window mill is laterally directed into the casing.

7. The invention as set forth in claim 6 wherein the diameter of the second mill is about the same as the diameter of the window mill.

8. The invention as set forth in claim 7 further comprising a third mill affixed to a shaft, the third mill being spaced from the second mill and serving to elongate the window cut by the window mill and the second mill, the third mill also serving to dress the window formed in the casing.

9. The apparatus as set forth in claim 8 wherein the third mill is a watermelon shaped mill with about the same diameter as the window mill and the second mill.

10. The invention as set forth in claim 7 wherein the whipstock forms a ramp surface below said end of the whipstock that is substantially parallel to the axis of the whipstock, the non-angled whipstock ramp surface allowing the window mill and the second upstream mill to simultaneously cut a window, when the second mill window cut merges with the window cut formed by the window mill, the parallel ramp surface transitions into a slightly angled ramp to direct the window mill and the second upstream mill further out through the casing.

11. A one trip side track window cutting apparatus for cutting sidetracking windows in a casing having an inside and outside diameter and a second cutability, the casing being positioned in previously drilled boreholes comprising;

a window cutting mill having a full diameter cutting surface and a reduced diameter tapered cutting surface; and a whipstock having a ramp with a taper adjacent to an end and a first cutability, said ramp having a reduced thickness adjacent said end and increasing to an enlarged thickness;

said reduced diameter cutting surface contacting said ramp at a first contact area and said full diameter cutting surface contacting the inside diameter of the casing at a second contact area; and said cutting tool creating a first contact stress between said reduced diameter cutting surface and said ramp and a second contact stress between said full diameter cutting surface and the inside diameter of the casing, a first ratio of said first cutability divided by said second cutability and a second ratio of said first contact stress divided by said second contact stress, said first ratio times said second ratio being less than one.

12. The apparatus of claim 11 wherein said ramp has an angle in the range of 1 to 45° with respect to the axis of the whipstock.

13. The apparatus of claim 11 wherein said ramp has an angle in the range of 2 to 30° with respect to the axis of the whipstock.

14. The apparatus of claim 11 wherein said ramp has an angle in the range of 3 to 15° with respect to the axis of the whipstock.

15. The apparatus of claim 11 wherein said reduced diameter cutting surface has a first height and said full diameter cutting surface has a second height, said first height being greater than said second height.

16. The apparatus of claim 4 wherein said reduced diameter cutting surface has a first height and said full diameter cutting surface has a second height, said first height being at least 30% of said first and second heights.

17. The apparatus of claim 11 wherein the tapers of said ramp at said end and said reduced diameter cutting surface are substantially the same.

18. The apparatus of claim 11 wherein said mill has a radius and said enlarged thickness of said ramp plus said mill radius are larger than the outside diameter of the casing causing said mill to move laterally through the wall of the casing.

19. The apparatus of claim 11 wherein said full diameter cutting surface has a diameter over 75% of the inside diameter of the casing.

20. A method of drilling a window in a casing having an inside and outside diameter and disposed in a well comprising:

disposing a first cutting member and a whipstock within the casing;

engaging a first contact surface on the first cutting member with a first ramp surface on the whipstock;

engaging a second contact surface on the first cutting member with the interior of the casing;

applying a force to the first cutting member creating a first contact stress at said first contact area and a second contact stress at said second contact area;

providing a first ratio of the cutability of the whipstock to the cutability of the casing and a second ratio of the first contact stress to the second contact stress with the first ratio times the second ratio being less than one; and passing the centerline of the first cutting member from the inside diameter to the outside diameter of the casing.

21. A cutter apparatus for cutting a window through the wall in an existing borehole, comprising:

a body having a generally flat bottom cutting surface, a full diameter cutting surface, and a reduced diameter cutting surface disposed between said bottom cutting surface and said full diameter cutting surface;

said full diameter cutting surface having a first axial height and being substantially full gauge;

said reduced diameter cutting surface having a second axial height;

said second axial height being at least 30% of said first plus said second axial heights; and said bottom cutting surface having a diameter which is at least 30% of the diameter of said full diameter cutting surface.

22. A method of drilling a window in a casing comprising:

engaging a tapered cutting surface on a mill with a whipstock in the cased borehole;

increasing the contact area between the mill and whipstock until the contact stress between the mill and whipstock is less than the contact stress between the mill and casing; and cutting a window in the casing.

23. The method of claim 22 further comprising deflecting the center of a bottom cutting surface of the mill from the interior to the exterior of the casing.

24. The method of claim 22 wherein the cutability of the whipstock is less than the cutability of the casing.

25. A side track cutting apparatus for cutting a secondary borehole through the wall of an existing borehole and into the formation, comprising:

a cutting tool affixed to the end of a shaft, the cutting tool having a tapered cutting surface forming a cutting angle;

said cutting tool having a plurality of cutting elements including carbide cutters and polycrystalline diamond cutters; and a whipstock having a ramp with a ramp angle substantially the same as the cutting angle of the tapered cutting surface, said ramp having a range of thickness deflecting the center of the cutting tool into the wall of the existing borehole to drill the secondary borehole through the wall of the existing borehole and into the formation.

26. A one trip side track window cutting apparatus for cutting sidetracking windows in a pipe casing positioned in previously drilled boreholes comprising;

a window cutting mill affixed to an end of a shaft, a body of the mill with a tapered cutting end forming a cutting angle;

said cutting mill having a plurality of cutting elements including carbide cutters and polycrystalline diamond cutters; and a whipstock having an axis and a ramp forming a ramp angle, the ramp angle substantially parallels the cutting angle of the tapered cutting end of the window mill, said ramp acting as a bearing surface for laterally forcing the center of the window mill from the interior to the exterior of the pipe casing to drill through the wall of the pipe casing and into the formation.

27. A mill for engaging an angled bearing surface on a whipstock to cut a secondary borehole through an existing steel casing of an existing borehole and into the earth formation comprising:

a body having a longitudinal axis;

a plurality of cutting blades arrayed around the body, at least a portion of the cutting blades comprising:

a lower end cutting portion transverse to the axis of the body and extending to approximately the axis of the body;

a first elongated milling portion extending along a principal portion of the body and having an angle which substantially parallels the angled bearing surface of the whipstock;

a second milling portion near the upper end of the body and being substantially parallel to the axis of the body; and a plurality of carbon cutters and polycrystalline diamond cutters on said cutting blades milling the steel casing and drilling into the earth formation.

28. A mill according to claim 27 wherein each blade also comprises a third milling portion extending along the body and having a relatively smaller angle to the axis of the body cutting the secondary borehole.

29. A mill according to claim 27 wherein the maximum diameter of the body corresponds to the desired diameter of the secondary borehole.

30. A mill for engaging a whipstock to cut a secondary borehole through a steel casing in an existing borehole and into the earth formation comprising:

a generally round body having a longitudinal axis;

a plurality of cutting blades arrayed around the body, at least a portion of the cutting blades comprising:

a lower end cutting portion transverse to the axis of the body and extending to approximately the axis of the body;

a first elongated milling portion extending along a principal portion of the body and having a relatively larger angle relative to the axis of the body engaging the whipstock;

a second milling portion extending along the body and having a relatively smaller angle to the axis of the body;

a third milling portion near the upper end of the body and being substantially parallel to the axis of the body; and a plurality of carbon cutters and polycrystalline diamond cutters on said cutting blades milling a window through steel casing and drilling a secondary borehole in the earth formation.

* * * * *